US009844254B2

(12) United States Patent
Kim

(10) Patent No.: US 9,844,254 B2
(45) Date of Patent: Dec. 19, 2017

(54) LIPSTICK CASE

(71) Applicant: YONWOO CO., LTD., Incheon (KR)

(72) Inventor: Min-goo Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 15/305,810

(22) PCT Filed: Apr. 14, 2016

(86) PCT No.: PCT/KR2016/003874
§ 371 (c)(1),
(2) Date: Mar. 29, 2017

(87) PCT Pub. No.: WO2016/171427
PCT Pub. Date: Oct. 27, 2016

(65) Prior Publication Data

US 2017/0245620 A1 Aug. 31, 2017

(30) Foreign Application Priority Data

Apr. 22, 2015 (KR) ..... 10-2015-0056514

(51) Int. Cl.
*A45D 40/06* (2006.01)
*A45D 40/20* (2006.01)

(52) U.S. Cl.
CPC ..... *A45D 40/06* (2013.01); *A45D 2040/208* (2013.01)

(58) Field of Classification Search
CPC ..... A45D 40/06; A45D 40/02; A45D 40/00; A45D 40/12; A45D 40/20; A45D 2040/205; A45D 2040/208
See application file for complete search history.

(56) References Cited

U.S. PATENT DOCUMENTS 3,091,329 A * 5/1963 Levine ..... A45D 40/06 401/117
5,988,919 A * 11/1999 Kuo ..... A45D 40/02 401/102
6,561,711 B1 5/2003 Pierpont

FOREIGN PATENT DOCUMENTS

| | | | |
|---|---|---|---|
| JP | 2005-066137 | A | 3/2005 |
| KR | 20-0348012 | Y1 | 4/2004 |
| KR | 20-0388883 | Y1 | 7/2005 |
| KR | 20-0393383 | Y1 | 8/2005 |
| KR | 10-1532539 | B1 | 7/2015 |

OTHER PUBLICATIONS

International Search Report issued in PCT/KR2016/003874 dated Aug. 4, 2016.

* cited by examiner

*Primary Examiner* — David Walczak
(74) *Attorney, Agent, or Firm* — Marshall, Gerstein & Borun LLP

(57) ABSTRACT

A lipstick case having a structure wherein a lipstick is exposed outwards when lowering an ascending and descending member which encases the lipstick as rotating a rotation body to one side direction, whereas the lipstick is hidden by the ascending and descending member when the rotation body to the other side direction is rotated and thereby the ascending and descending member ascends. Therefore, it is possible to fundamentally prevent problems in use, e.g. a breakage of lipstick caused by closing a cover part in a state of the lipstick being ascended.

5 Claims, 8 Drawing Sheets

LIPSTICK CASE

BACKGROUND OF THE INVENTION

The present invention disclosed herein relates to a lipstick case, and more particularly, to a lipstick case having a structure wherein a lipstick is exposed outwards when lowering an ascending and descending member which encases the lipstick as rotating a rotation body to one side direction, whereas the lipstick is hidden by the ascending and descending member when the rotation body is rotated to the other side direction and thereby the ascending and descending member ascends. Therefore, it is possible to fundamentally prevent problems in use, e.g. a lipstick breakage caused by closing a cover part in a state of the lipstick being ascended.

Generally, a solid lipstick has a structure wherein a solid-type stick can be ascended and descended out of a container by rotating a rotation body provided at a lower portion of the container after opening a cover. For example, to use a lipstick, a user should open a cover of the container first, rotate a rotation body, and ascend it to expose the stick outwards. After using, the user should lower the stick to make the stick received inside of the container.

"A lipstick case" having the same structure as the above is disclosed in FIG. 1 of Korean Registered Utility Model No. 20-0241614 (Hereafter, it will be referred as 'the registered utility model').

The registered utility model has a structure wherein as a lipstick (2) is interlocked to a lipstick holder (3), a fixing protrusion (4) of a lipstick holder (3) is interlocked to a spiral groove (6) formed at an inner portion of a rotating tube (5), and thereby the lipstick holder is coupled to the rotating tube (5). A guiding tube (7) is inserted between the lipstick holder (3) and the rotating tube (5) and fitted with the rotating tube (5) by a spiral protrusion (9) with a fitted combination. Meanwhile, the fixing protrusion (4) of the lipstick holder (3) is disposed inside of a guide groove (8) of a guide tube (7) and at the same time disposed at a spiral groove (6).

However, the registered utility model has a structure wherein when the rotating tube (5) is rotated by grabbing the guide tube (7) with a hand, the fixing protrusion (4) hung between the spiral groove (6) and the guide groove (8) is ascended along with a lipstick (2) fitted to the lipstick holder (3), such that the lipstick (2) can be applied. However, in case a cover is closed in a state of the lipstick (2) being ascended, an upper end of the lipstick (2) is smashed, which may lead to the breakage of the lipstick (2).

Furthermore, to check a residual amount of the lipstick (2), the lipstick (2) should be ascended all the way to the end thereof, which may cause user's inconvenience.

SUMMARY OF THE INVENTION

The present invention is devised to solve such problems described in the above, and the objectives thereof are to provide a lipstick case having a structure wherein a lipstick is exposed outwards when lowering an ascending and descending member which is encasing the lipstick as rotating a rotation body to one side direction, whereas the lipstick is hidden by the ascending and descending member when rotating the rotation body to the other side direction and thereby ascending the ascending and descending member. Therefore, it is possible to fundamentally prevent problems in use, such as a problem that a lipstick is damaged by closing a cover part in a state of the lipstick being ascended.

Furthermore, it is possible to intuitively check the residual amount of the lipstick according to a height of a lipstick receiving tube, and it will bring user's convenience.

To solve problems above, it is characterized that a lipstick case according to the present invention is characterized in including: a lipstick holder where a lipstick is put on; a rotation body including a fixing body which is disposed at a lower portion of the lipstick holder and protrudes from the center portion of a lower end thereof to an upward direction so as to fix the lipstick holder and a first screw thread at an inner circumferential surface thereof; an ascending and descending member, further including a second screw thread which is combined with a screw combination to the first screw thread at an outer circumferential surface so as to be ascended and descended by the rotation of the rotation body, receiving the lipstick when ascended and exposing the lipstick outwards when descended; an ascending and descending guide member which is coupled rotatably with the rotation body and equips a rotation-prevention means which prevents the rotation of the ascending and descending member when the rotation body is rotating and guides the vertical movement of the ascending and descending member; and a cover part which encases the lipstick and is detachably coupled to the ascending and descending guide member.

Furthermore, it is characterized that the ascending and descending member is characterized to have a guide tube which has the fixing body inserted in and a second screw thread formed at an outer circumferential surface, and a lipstick receiving tube which extends from the guide tube to an upper portion thereof and receives the lipstick.

Furthermore, it is characterized that the rotation-preventing means is composed of a penetrating hole formed at a lower end of the ascending and descending member such that the ascending and descending member can be penetrated and thereby ascended and descended, wherein the penetrating hole has a form of an oval so as to prevent a rotation of the lipstick receiving tube, and the guide tube is configured to be corresponded to the shape of the penetrating hole.

Furthermore, it is characterized that the rotation-preventing means is disposed at an upper portion of the ascending and descending member, and composed of a rotation guiding part which has a square shape with the corners rounded such that the lipstick receiving tube is prevented from rotating, wherein the lipstick receiving tube is configured to be corresponded to the shape of the ascending and descending member.

Furthermore, it is characterized that at the ascending and descending member is provided a limiting protrusion which meets a lower end of the lipstick holder or a protrusion of the ascending and descending member and thereby limits the ascent of the ascending and descending member.

As described above, according to the present invention, a lipstick is exposed outwards when an ascending and descending member which encases the lipstick descends according to the rotation of a rotation body to one side direction, whereas the lipstick is hidden by the ascending and descending member when the ascending and descending member ascends by rotating the rotation body to the other side direction. Therefore, it is possible to fundamentally prevent problems in use, such as a problem that a lipstick is damaged by closing a cover part in a state of the lipstick being ascended.

Furthermore, according to the height of the lipstick receiving tube, it is possible to easily check the residual amount of the lipstick, thereby providing user's convenience.

DETAILED DESCRIPTION OF PREFERRED EMBODIMENTS

Figure 1:
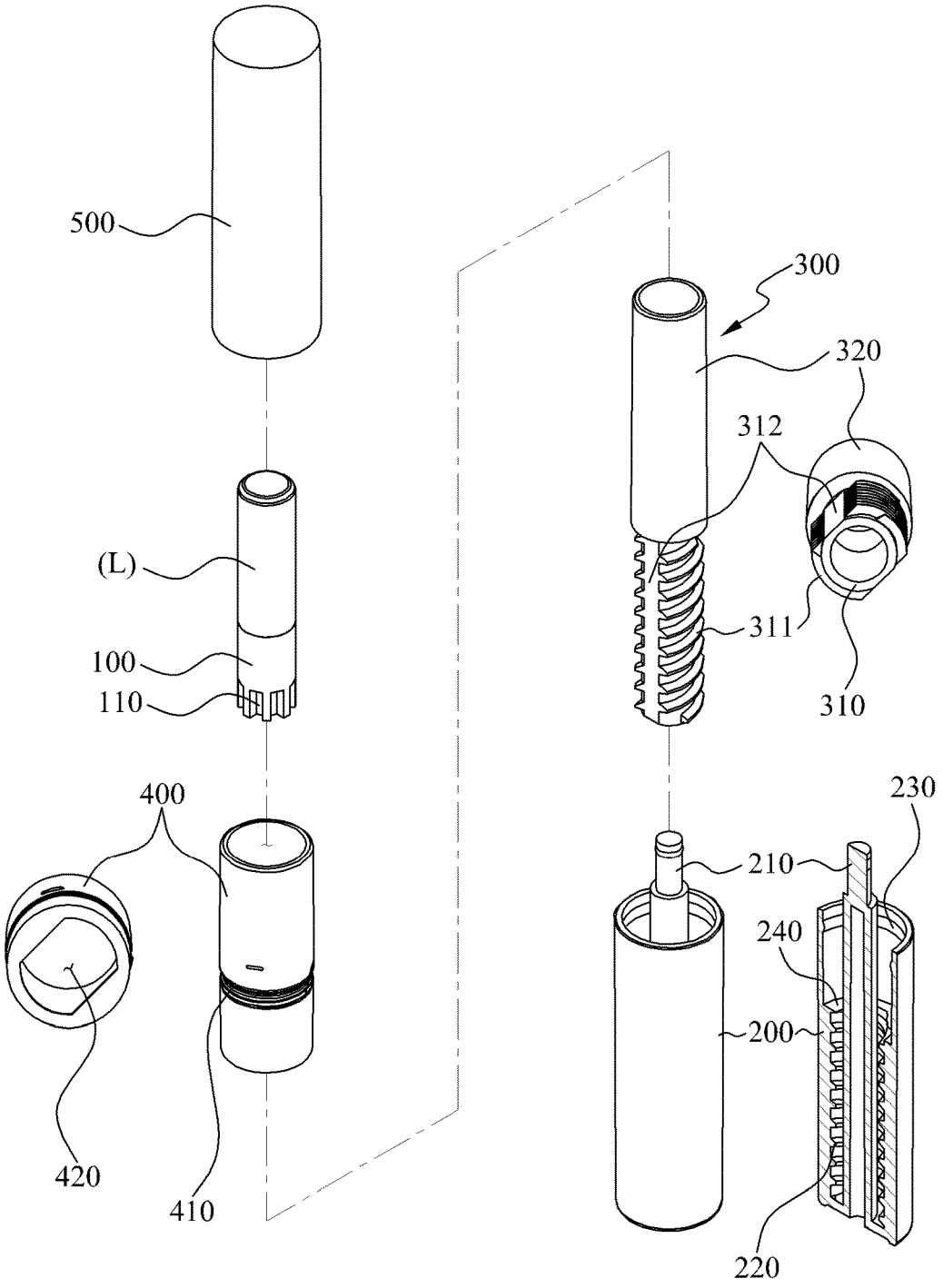
FIG. 1 is an exploded perspective view illustrating a configuration of a lipstick case according to an exemplary embodiment of the present invention.

Hereinafter, exemplary embodiments of the present invention will be described in detail with reference to the accompanying drawings. The same reference numerals provided in the drawings indicate the same members.

Figure 2:
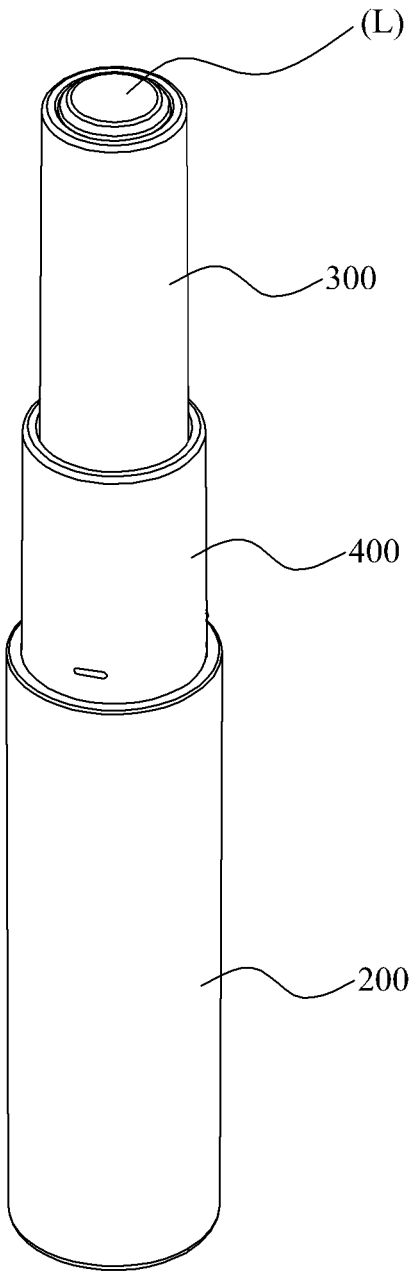
FIG. 2 is an assembled perspective view illustrating a configuration of a lipstick case according to an exemplary embodiment of the present invention.
Figure 3:
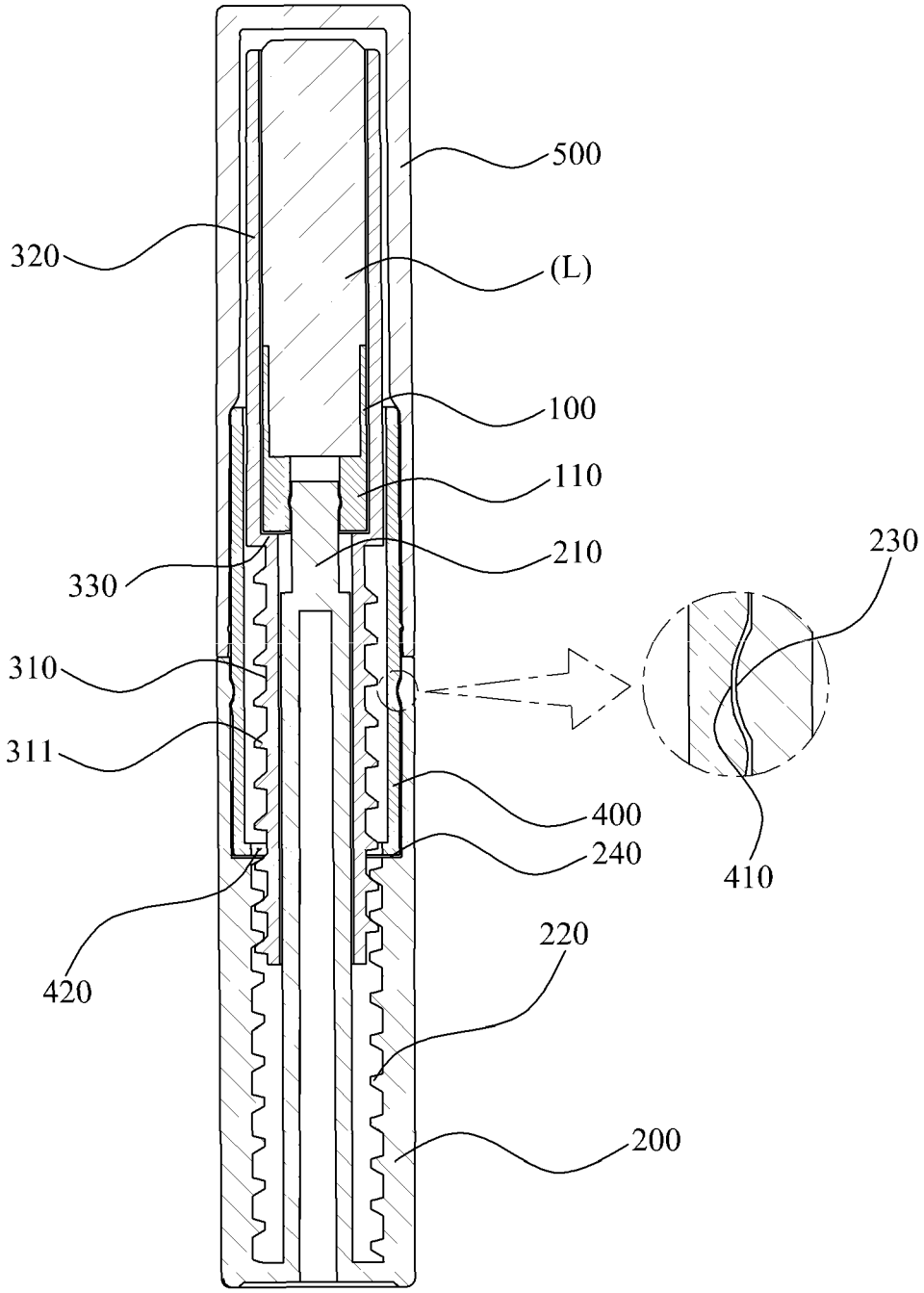
FIG. 3 is a combined cross-sectional view illustrating a configuration of a lipstick case according to an exemplary embodiment of the present invention.

FIG. 1 is an exploded perspective view illustrating a configuration of a lipstick case according to an exemplary embodiment of the present invention. FIG. 2 is an assembled perspective view illustrating a configuration of a lipstick case according to an exemplary embodiment of the present invention. FIG. 3 is a combined cross-sectional view illustrating a configuration of a lipstick case according to an exemplary embodiment of the present invention.

Referring to FIGS. 1 to 3, a lipstick case according to an exemplary embodiment of the present invention includes a lipstick holder 100, a rotation body 200, an ascending and descending member 300, an ascending and descending guide member 400, and a cover part 500.

The lipstick holder 100 is loaded with a lipstick (L) at an upper part thereof and supports the lipstick (L), comprising a coupling part 110 at a lower portion thereof so as to be coupled with a fixing body 210 of a rotation body 200 to be described later.

The rotation body 200 is coupled to a coupling part 110 of the lipstick holder 100 at a lower portion of the lipstick holder 100 and fixes the lipstick holder 100, and thereby ascends and descends an ascending and descending member 300 by a rotation according to a user's control. In the present invention, it is characterized that at the rotation body 200 is provided a fixing body 210 which is formed protrusively to an upper direction from a center portion of a lower end thereof such that the fixing body 210 can be coupled to a coupling part 110 and fix the lipstick holder 100.

The fixing body is coupled to the coupling part 110 and supports the lipstick holder 100, such that it is possible to keep the lipstick (L) in a fixed state all the time without changing the position of the lipstick (L).

Furthermore, at an inner circumferential surface of the rotation body 200 is provided a first screw thread 220 which is coupled with a second screw thread 311 of the ascending and descending member 300 to be described later and guides the ascending and descending member 300 to ascend and descend. When the rotation body 200 is rotated to one side direction, the second screw thread 311 descends along the first screw thread 220 and thereby the ascending and descending member 300 descends, whereas when the rotation body 200 is rotated to the other side direction, the second screw thread 311 ascends along the first screw thread and thereby the ascending and descending member 300 ascends.

Meanwhile, the rotation body 200 comprises a coupling protrusion 230 coupled with a coupling groove 410 of the ascending and descending guide member 400 at an inner side thereof so as to be rotated along with the ascending and descending guide member 400.

Furthermore, a securing protrusion 240 is provided at an upper portion of the first screw thread 220 at an inner side of the rotation body 200 such that the ascending and descending guide member 400 can be secured.

The ascending and descending member 300 which is ascended and descended by a rotation of the rotation body 200 includes a guide tube 310 and a lipstick receiving tube 320.

The guide tube 310 has a tubular shape which has an inner space such that the fixing body 210 can be inserted and comprises a second screw thread 311 at an outer circumferential surface so as to be coupled with the first screw thread 220 in a screw coupling, wherein the ascending and descending member 300 can ascend or descend as the first screw thread 220 forms a screw coupling through the second screw thread 311.

Meanwhile, the guide tube is configured to have a shape that corresponds to the shape of a penetrating hole 420 which has an oval shape such that the ascending and descending member 300 can be prevented from being rotated when the rotation body 200 rotates and move vertically. It is preferred that the guide tube 310 has a cross-sectional plane on both sides thereof so as to have a corresponding shape with the penetrating hole 420 having an oval shape.

The lipstick receiving tube 320 which extends from the guide tube 310 to an upper portion thereof and receives the lipstick (L) and the lipstick holder 100. In this present invention, it is characterized that the lipstick receiving tube 320 is configured to receive the lipstick (L) or expose the lipstick (L) to the outside according to the ascent and descent of the ascending and descending member 300.

The lipstick receiving tube 320 is configured to expose the lipstick (L) to the outside when a guide tube 310 descends according to a rotation of the rotation body 200 to one side direction, whereas the lipstick receiving tube 320 encases and receives the lipstick (L) when the guide tube 310 ascends according to the rotation of the rotation body 200 to the other side direction. It does not have a structure where the lipstick (L) ascends and is exposed outwards from the lipstick receiving tube as in an existing lipstick, rather has a structure where the lipstick receiving tube 320 receives the lipstick or exposes the lipstick outwards by ascending and descending in a state that the position of the lipstick (L) and the lipstick holder 100 is not changed. Therefore, it is possible to fundamentally prevent problems in use, such as a problem that a lipstick is damaged by closing a cover part in a state of the lipstick being ascended.

Furthermore, the lipstick receiving tube 320 ascends the lipstick (L) to match the height of the lipstick (L) when the height of the lipstick (L) is lowered according to usage of the lipstick, which makes it possible to easily check the remaining amount of the lipstick (L) by seeing the height of the lipstick receiving tube 320.

Meanwhile, at an inner side of the ascending and descending member 300 is provided a limiting protrusion 330 which meets a lower end of the lipstick receiving holder 100 and limits the ascent of the ascending and descending member 300 during an ascending process of the ascending and descending member 300.

The ascending and descending guide member 400 is secured to a securing protrusion 240 which is secured at an inner side of the rotation body 200 and is protrusively coupled to the rotation body 200, further comprising a coupling groove 410 which is coupled to a coupling protrusion 230 of the rotation body 200 at an outer circumferential surface thereof.

In the present invention, it is characteristic that at the ascending and descending member 300 is provided a rotation preventing means which prevents the rotation of the ascending and descending member 300 and guides the vertical movement of the ascending and descending member 300, wherein the rotation preventing means comprises a penetrating hole 420 which is formed at a lower end of the ascending and descending guide member 400 such that the ascending and descending member 300 can penetrate therein, ascending and descending. The penetrating hole 420 can be composed of an oval shape in order to prevent the rotation of the guide tube 310. In this case, the guide tube 310 is preferred to have a cross-sectional plane 312 which corresponds to the shape of the penetrating hole 420 such that the guide tube 310 can move vertically without rotating.

In drawings of the present invention, the shape of the penetrating hole 420 is drawn as an oval shape; however, a variety of shapes which can guide the vertical movement of the guide tube 310 without being are possible to be configured.

The cover part 500 is coupled detachably to the ascending and descending guide member 400, encasing the lipstick (L) and the lipstick receiving tube 320, and prevents contamination of the lipstick (L), e.g., getting foreign matter on the lipstick (L), by closing an opened upper end of the lipstick receiving tube 320.

Figure 4:
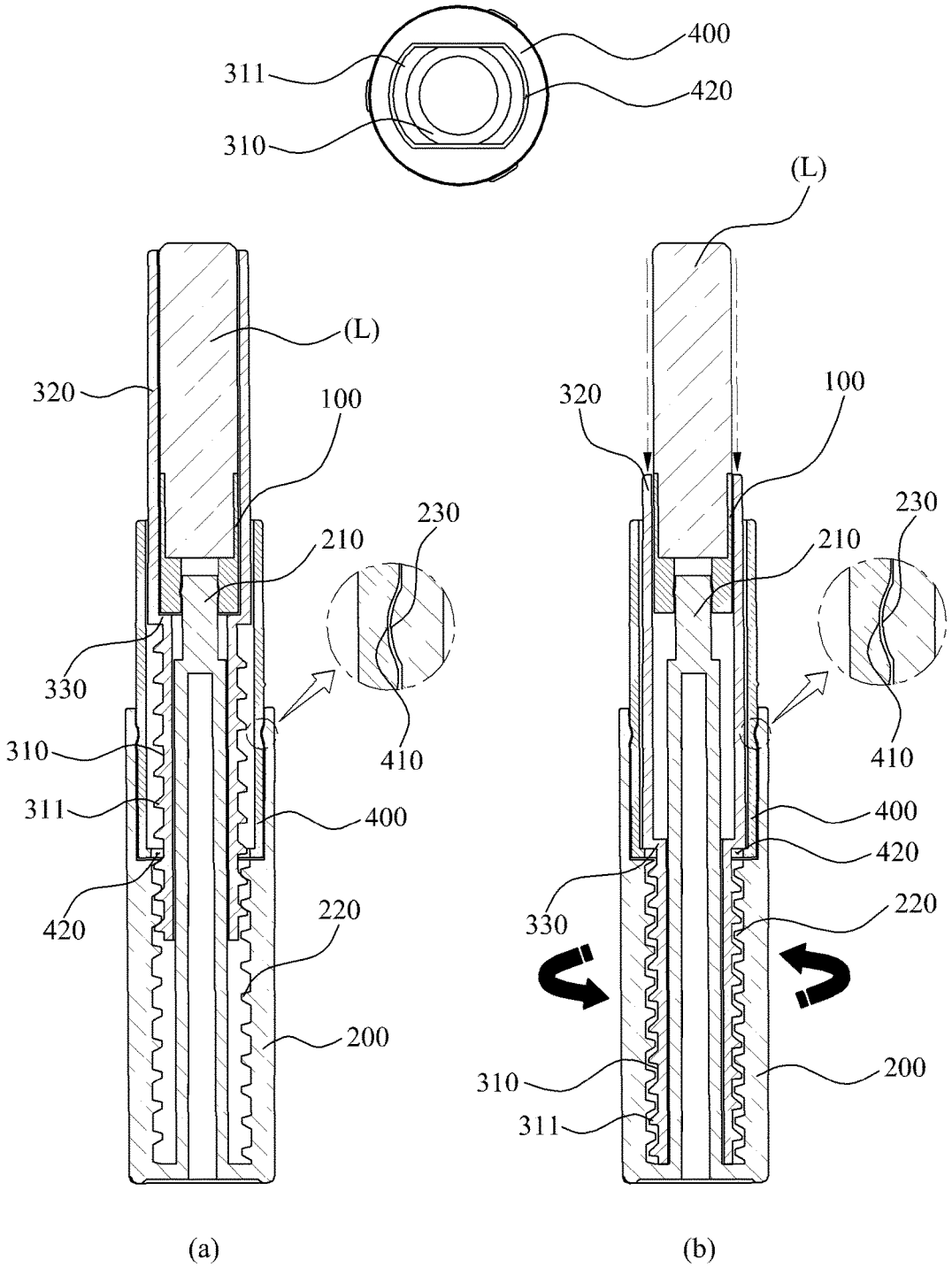
FIG. 4 is a view illustrating an operational state of a lipstick case according to an exemplary embodiment of the present invention.

Hereinafter, referring FIG. 4, an operational method of a lipstick case according to an exemplary embodiment of the present invention will be described. FIG. 4 is a view illustrating an operational state of a lipstick case according to an exemplary embodiment of the present invention.

Referring FIG. 4, when a user rotates the rotation body 200 to one side direction after pressurizing the ascending and descending guide member 400 with one hand in a state that the lipstick receiving tube 320 of the ascending and descending member 300 encases and receives the lipstick (L), the guide tube 310 is descended by the screw coupling of a first screw thread 220 of the rotation body 200 and a second screw thread 311 of the guide tube 310. Due to this, the lipstick receiving tube 320 which is combined integrally to an upper portion of the guide tube 310 descends along, such that the lipstick (L) is exposed to the outside.

At this time, the guide tube 310 is preferred to be configured to have a shape which corresponds to the shape of a penetrating hold 420 of the ascending and descending guide member 400.

As the above, when a user rotates the rotation body 200 to the other side direction after pressurizing the ascending and descending guide member 400 with one hand in a state that the lipstick (L) is exposed to the outside as the lipstick receiving tube 320 descends, the guide tube 310 is ascended by a screw coupling of a first screw thread 220 of the rotation body 200 and a second screw thread 311 of the guide tube 310. Due to this, the lipstick receiving tube 320 which is combined integrally to an upper portion of the guide tube 310 ascends along, and thereby receives the lipstick (L).

A lipstick case according to another exemplary embodiment of the present invention is configured to guide a vertical movement of the ascending and descending member 300 through a penetrating hole 420 which has an oval shape and is formed at a lower end of the ascending and descending guide member 400. A lipstick (L) is configured to be disposed fixedly all the time, either being exposed to the outside or being received in the lipstick receiving tube 320. Therefore, it is possible to fundamentally prevent problems caused by the structure of the existing lipsticks in which a lipstick itself ascends and descends, e.g. a breakage of a lipstick caused when closing a cover part in a state of the lipstick being ascended.

Figure 5:
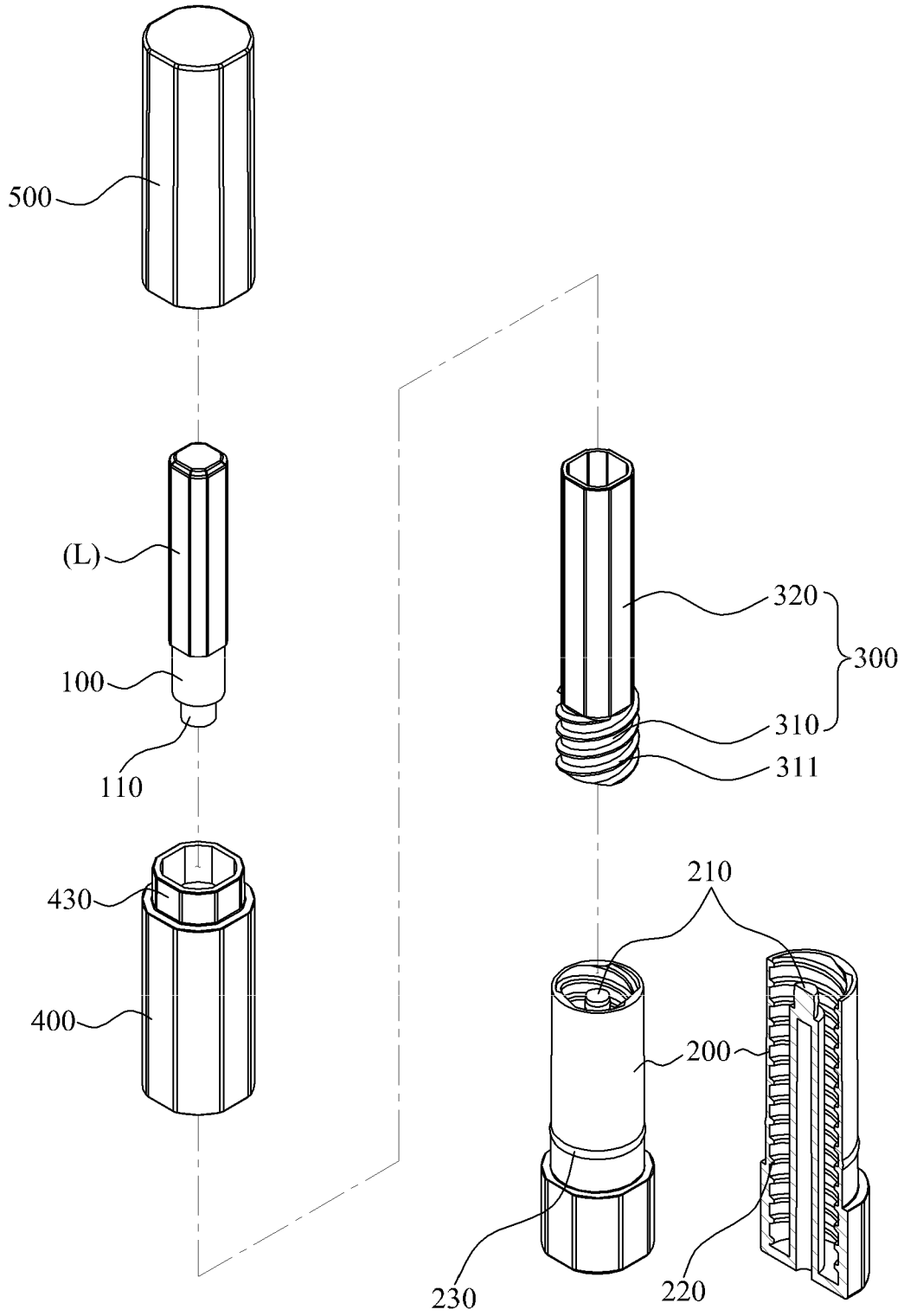
FIG. 5 is an exploded perspective view illustrating a configuration of a lipstick case according to another exemplary embodiment of the present invention.
Figure 6:
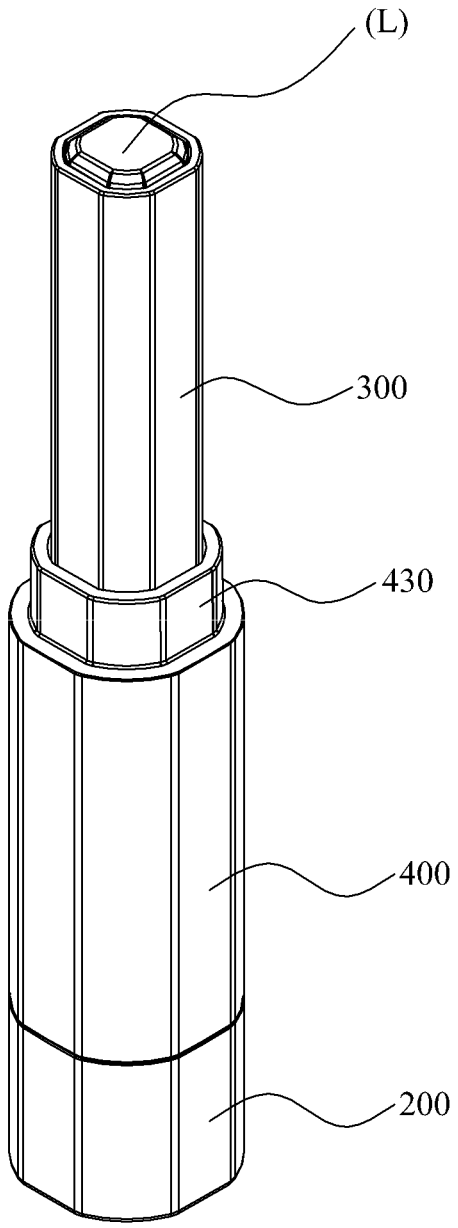
FIG. 6 is an assembled perspective view illustrating a configuration of a lipstick case according to another exemplary embodiment of the present invention.
Figure 7:
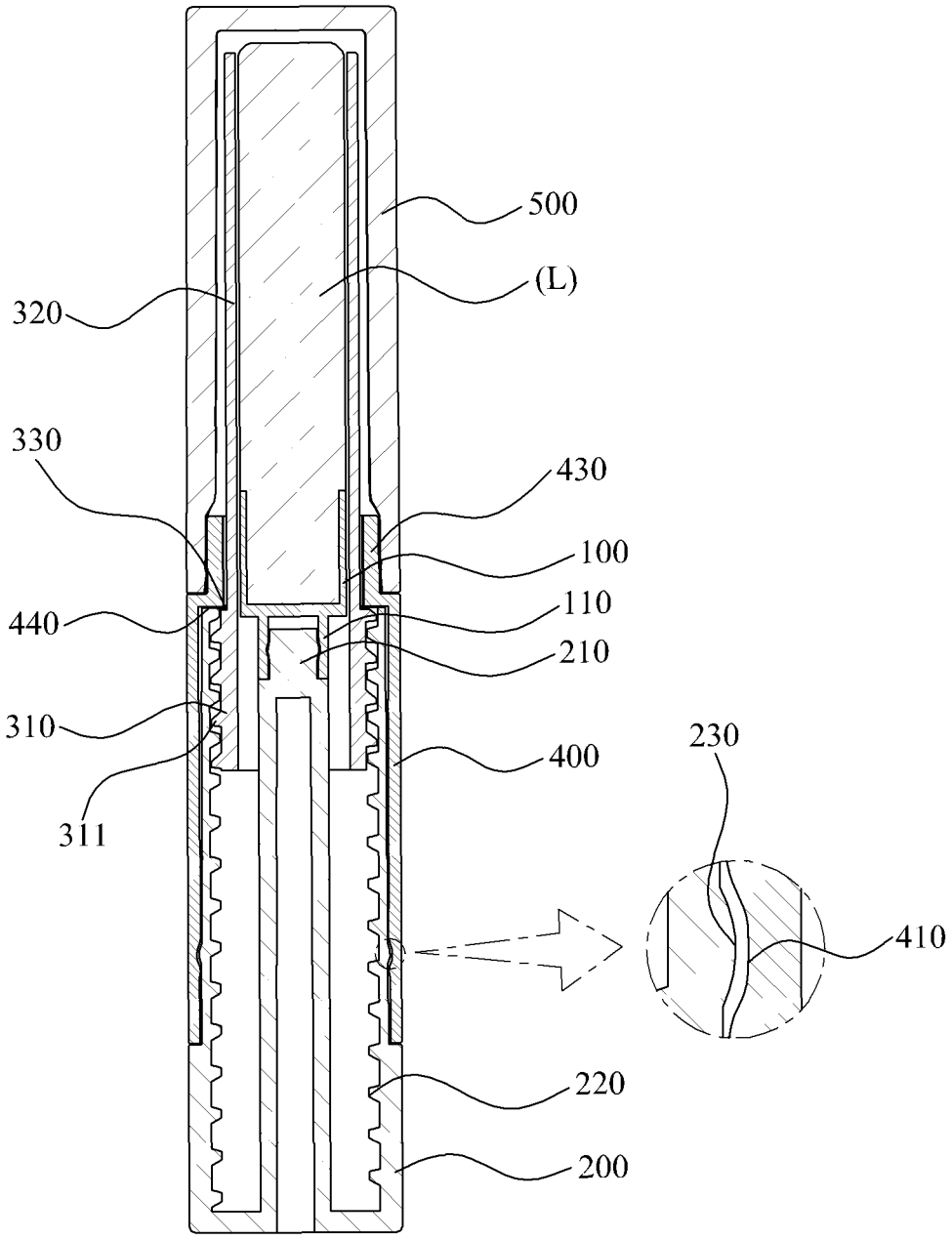
FIG. 7 is a combined cross-sectional view illustrating a configuration of a lipstick case according to another exemplary embodiment of the present invention.

Hereinafter, with reference to FIGS. 5 and 7, a lipstick case according to another exemplary embodiment of the present invention will be described in detail. FIG. 5 is an exploded perspective view illustrating a configuration of a lipstick case according to another exemplary embodiment of the present invention. FIG. 6 is an assembled perspective view illustrating a configuration of a lipstick case according to another exemplary embodiment of the present invention. FIG. 7 is a combined cross-sectional view illustrating a configuration of a lipstick case according to another exemplary embodiment of the present invention.

Referring FIGS. 5 to 7, a lipstick case according to another exemplary embodiment of the present invention includes an ascending and descending guide member 400 rotatably coupled at an outer side of a rotation body 200. In the present invention, it is characteristic that a rotation preventing means is equipped at an upper portion of the ascending and descending guide member 400 such that the rotation preventing means can prevent a rotation of the ascending and descending member 300 when the rotation body 200 rotates, and guides the ascending and descending member 300 to move vertically.

The rotation preventing means according to another exemplary embodiment of the present invention is configured to have a rotation guiding part 430 of a square shape such that the rotation preventing means is disposed at an upper portion of the ascending and descending guide member 400 and prevents a rotation of the lipstick receiving tube 320. In this case, the lipstick receiving tube 320 is preferred to have a shape which corresponds to the shape of the rotation guiding part 430 such that the lipstick receiving tube 320 is not rotated but is guided to move vertically.

Meanwhile, generally the rotation guiding part 430 is preferred to have a shape with all corners rounded in order to give a similar feeling with the shape of a tubular lipstick.

In drawings of the present invention, the shape of the rotation guiding part 430 is drawn as a square shape; however, a variety of shapes which can guide the vertical movement of the guide tube 310 without being are possible to be configured.

Meanwhile, a protrusion 440 is provided at an inner side of the ascending and descending guide member 400 so as to meet an upper end of the limiting protrusion 330 and limit the ascent of the ascending and descending member 300 in a process that the ascending and descending member 300 is ascending.

Detailed explanations of the rest structures according to another exemplary embodiment of the present invention are omitted because they are the same with the structures according to an exemplary embodiment of the present invention.

Figure 8:
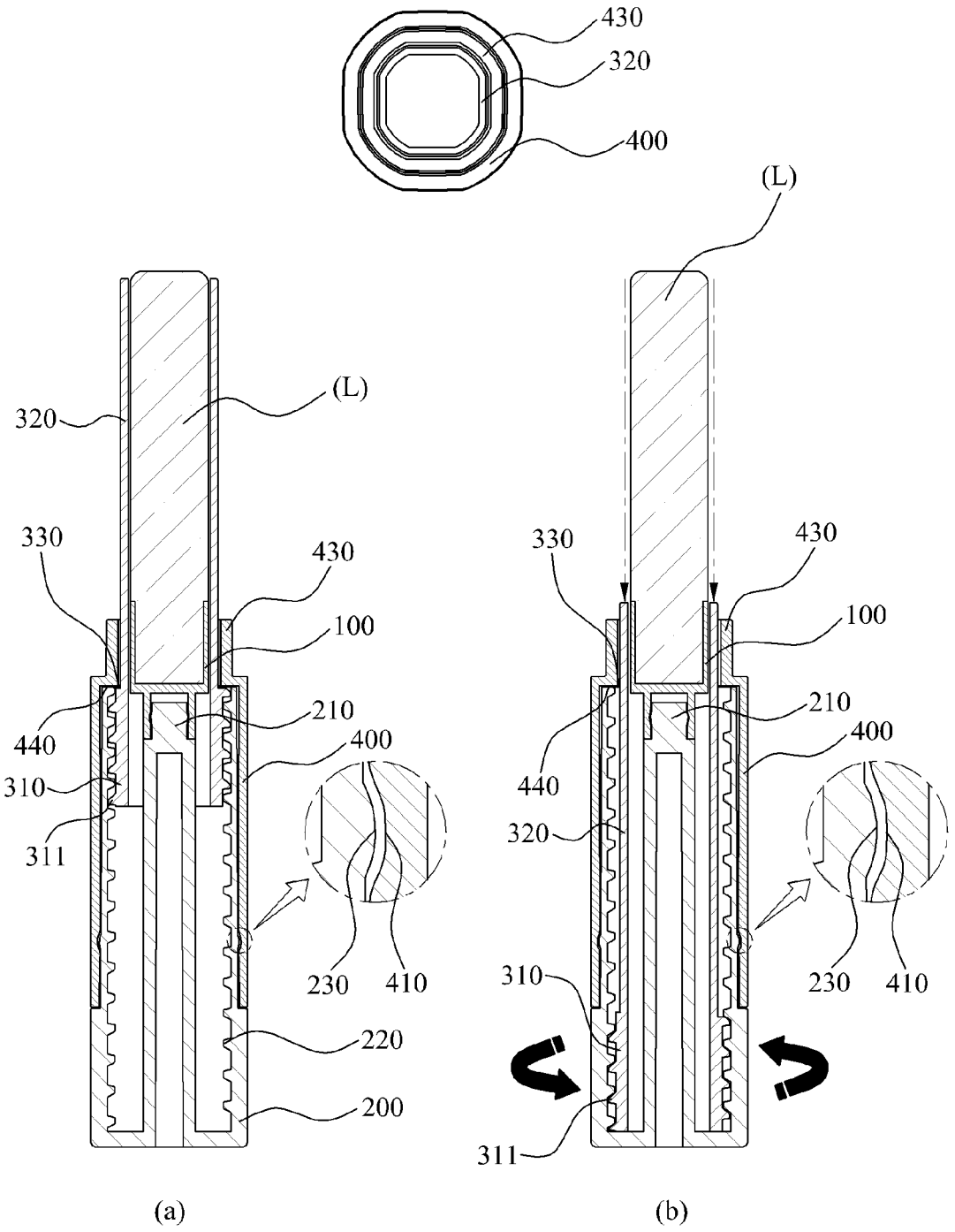
FIG. 8 is a view illustrating an operational state of a lipstick case according to another exemplary embodiment of the present invention.

Hereafter, referring FIG. 8, the method of use of a lipstick case according to an exemplary embodiment of the present invention will be described. FIG. 8 is a view illustrating an operational state of a lipstick case according to another exemplary embodiment of the present invention.

Referring FIG. 8, when a user rotates the rotation body 200 to one side direction after pressurizing the ascending and descending guide member 400 with one hand in a state that the lipstick receiving tube 320 of the ascending and descending member 300 encases and receives the lipstick (L), the guide tube 310 descends by a screw coupling of a first screw thread 220 of the rotation body 200 and a second screw thread 311 of the guide tube 310. Due to this, the lipstick receiving tube 320 which is combined integrally to an upper portion of the guide tube 310 descends along with the lipstick receiving tube 320, such that the lipstick (L) is exposed to the outside.

At this time, it is preferred that the lipstick receiving tube 320 has a shape which corresponds to the shape of the rotation guiding member 430 of the ascending and descending guide member 400 so as to move vertically without being rotated.

As the above, when a user rotates the rotation body 200 to the other side direction after pressurizing the ascending and descending guide member 400 with one hand in a state that the lipstick (L) is exposed to the outside as the lipstick receiving tube 320 descends, the guide tube 310 is ascended by a screw coupling of a first screw thread 220 of the rotation body 200 and a second screw thread 311 of the guide tube 310. Due to this, the lipstick receiving tube 320 which is combined integrally to an upper portion of the guide tube 310 ascends along, and thereby receives the lipstick (L).

A lipstick case according to another exemplary embodiment of the present invention is configured to guide a vertical movement of the ascending and descending member 300 through a rotation guiding part 430 which has a square shape and is formed at an upper portion of the ascending and descending guide member 400. A lipstick (L), the same as an exemplary embodiment of the present invention, is configured to be disposed fixedly all the time, either being exposed to the outside or being received in the lipstick receiving tube 320 by ascent and descent of the ascending and descending member 300. Therefore, it is possible to fundamentally prevent problems caused by the structure of existing lipsticks in which a lipstick itself ascends and descends, e.g., a breakage of a lipstick caused when closing a cover part in a state of the lipstick being ascended.

As described above, optimal embodiments have been disclosed in the drawings and the specification. Although specific terms have been used herein, these are only intended to describe the present invention and are not intended to limit the meanings of the terms or to restrict the scope of the present invention as disclosed in the accompanying claims. Therefore, those skilled in the art will appreciate that various modifications and other equivalent embodiments are possible from the above embodiments. Therefore, the scope of the present invention should be defined by the technical spirit of the accompanying claims.

What is claimed is:

1. A lipstick case comprising:

a lipstick holder loaded with a lipstick;

a rotation body including a fixing body disposed at a lower portion of the lipstick holder and protrusively formed from a center portion of a lower end thereof to an upper direction so as to fix the lipstick holder, and a first screw thread formed at an inner circumferential surface thereof;

an ascending and descending member including a second screw thread coupled in a screw coupling with the first screw thread at an outer circumferential surface thereof so as to be rotated by a rotation of the rotation body, wherein the ascending and descending member receives the lipstick when ascending, and exposes the lipstick to the outside when descending;

an ascending and descending guide member rotatably coupled with the rotation body, and comprising a rotation preventing means which prevents the ascending and descending member from being rotated when the rotation body rotates, and guides a vertical movement of the ascending and descending member; and a cover part encasing the lipstick and detachably coupled to the ascending and descending guide member.

2. The lipstick case of claim 1, wherein the ascending and descending member comprises: a guide tube wherein the fixing body is inserted and the second screw thread is formed at an outer circumferential surface thereof; and a lipstick receiving tube which is extended from the guide tube to an upper portion thereof and receives the lipstick.

3. The lipstick case of claim 2, wherein the rotation preventing means comprising a penetrating hole equipped at a lower end of the ascending and descending guide member such that the ascending and descending member can be penetrated to the penetrating hole and thereby ascended and descended, wherein the penetrating hole has an oval shape so as to prevent a rotation of the guide tube, and the guide tube has a shape which corresponds to the shape of the penetrating hole.

4. The lipstick case of claim 2, wherein the rotation preventing means comprises a rotation guiding part which is disposed at an upper portion of the ascending and descending guide member and has a square shape with all corners rounded so as to prevent a rotation of the lipstick receiving tube, wherein the lipstick receiving tube is configured to have a shape which corresponds to the shape of the rotation guiding part.

5. The lipstick case of claim 1, wherein at the ascending and descending member is provided a limiting protrusion which meets a lower end of the lipstick holder or a protrusion of the ascending and descending guide member and limits an ascent of the ascending and descending member during an ascending process.

* * * * *